US006951829B2

(12) United States Patent
Schindler et al.

(10) Patent No.: US 6,951,829 B2
(45) Date of Patent: Oct. 4, 2005

(54) NONWOVEN SCOURING FABRIC

(75) Inventors: Thomas Schindler, Friedberg (DE); Vanessa Lutzmann, Augsburg (DE)

(73) Assignee: Carl Freudenberg KG, Weinheim (DE)

( * ) Notice: Subject to any disclaimer, the term of this patent is extended or adjusted under 35 U.S.C. 154(b) by 73 days.

(21) Appl. No.: 10/119,360

(22) Filed: Apr. 9, 2002

(65) Prior Publication Data

US 2003/0003836 A1 Jan. 2, 2003

(30) Foreign Application Priority Data

Jun. 27, 2001 (DE) ..... 101 30 656

(51) Int. Cl.[7] ..... B24D 3/34
(52) U.S. Cl. ..... 442/365; 442/417; 451/532; 451/533
(58) Field of Search ..... 442/365, 417; 451/532, 533

(56) References Cited

U.S. PATENT DOCUMENTS 5,039,311 A * 8/1991 Bloecher ..... 51/295
5,928,070 A * 7/1999 Lux ..... 451/526

FOREIGN PATENT DOCUMENTS

| | | |
|---|---|---|
| DE | 69513297 | 6/2000 |
| EP | 0141863 | 3/1987 |
| GB | 986601 | 3/1965 |
| WO | WO 94/04738 | 3/1994 |
| WO | WO 97/49326 | 12/1997 |
| WO | WO 99/51401 | 10/1999 |

* cited by examiner

*Primary Examiner*—Elizabeth M. Cole
(74) *Attorney, Agent, or Firm*—Kenyon & Kenyon

(57) ABSTRACT

A nonwoven scouring fabric, including a fabric made of coarse fibers interconnected to one another to form a three-dimensional network; a continuous or a discontinuous layer of synthetic resin, or the like, adhering to the fibers, which has a content of abrasive grains; reflectors being additionally bonded at the surface of the layer, which are incorporated in the network by a scattering procedure via at least one side of the nonwoven scouring fabric.

20 Claims, No Drawings

NONWOVEN SCOURING FABRIC

BACKGROUND OF THE INVENTION

1. Field of the Invention

The invention relates to a nonwoven fabric for scouring which includes a fabric made of interconnected coarse fibers which form a three-dimensional network, a continuous or discontinuous layer of synthetic resin, or the like, having a content of abrasive grains adhering to the fibers.

2. Description of Related Art

Various scouring elements are known for cleaning procedures, which can satisfy various objectives. For instance, there are scouring elements made of sponge material, which are comparatively soft and are able to take up a great deal of water, but are only a little effective for (removing) stubborn dirt. Scouring elements made of organic fibers are also used, which have clearly greater abrasive capability. The abrasive capability of the fibers can even be reinforced by covering them with a layer of synthetic resin in which abrasive grains are embedded. A high abrasive effect is achieved by the abrasive grains. The fiber entities, as a rule, are made of nonwoven fabric in the form of a three-dimensional network, the fibers being bonded to one another at their crossing points. The bonding can take place by direct bonding of the fibers among one another or with the aid of an adhesive means. Nonwoven scouring fabrics of this kind are on the market. A scouring element which is made as a nonwoven scouring fabric having a sponge attached to it is commonly available.

During the course of the use of the nonwoven scouring fabric both the abrasive grains and the synthetic resin are used up, and the nonwoven abrasive fabric loses its effectiveness more and more. This is not recognizable immediately or without a doubt by the person using the nonwoven abrasive fabric. That is why nonwoven abrasive fabrics have the disadvantage that they lose their effectiveness with time, without this being recognized.

SUMMARY OF THE INVENTION

It is an object of the invention is to design the nonwoven scouring fabric in such a way that the loss of effectiveness becomes recognizable to the user.

These and other objects of the invention are achieved by a nonwoven scouring fabric, including a fabric made of interconnected coarse fibers forming a three-dimensional network, a continuous or a discontinuous layer of synthetic resin, or the like, adhering to the fibers and having a content of abrasive grains, wherein reflectors are additionally bonded at the surface of the layer which are incorporated into the network via at least one of the sides of the nonwoven scouring fabric by a scattering procedure.

DETAILED DESCRIPTION OF THE INVENTION

By incorporating reflectors into the nonwoven scouring fabric, it becomes visible to the user whether, and to what extent the nonwoven scouring fabric is still effective. Besides the abrasive grains, the reflectors are also fastened to the surface of the synthetic resin layer, which is present on the fibers. They are therefore used up to the same degree as the abrasive grains during use of the nonwoven scouring fabric. When the nonwoven scouring fabric no longer has visible reflectors, its effectiveness stemming from the abrasive grains is exhausted.

The reflectors can be incorporated into the network formed by the fibers by a scattering procedure. For this, the nonwoven scouring fabric can be subjected to the scattering procedure on one or both sides of its scouring sides. The reflectors can have different shapes. It is important that they have mirroring surfaces. Thus, for example, grain-shaped or platelet-shaped reflectors can be used. An irregular shape is preferred. The size of the reflector is selected so that, with respect to their average size, they are equal to, or slightly larger than, the abrasive grains used. It follows that they are in the micrometer range, and recognizable by the naked eye only via their reflecting surfaces.

The use of mica as reflectors is of advantage. But reflectors made of plastic are also possible.

During the production of the nonwoven scouring fabric, the reflectors can be incorporated together with the abrasive grains. However, it is also possible to put them in separately from the abrasive grains.

Preferably, the reflectors are put into the nonwoven scouring fabric evenly over the entire cross section. But another way of incorporating them is also possible, such as having the reflectors put into the nonwoven scouring fabric starting from one outer surface of the nonwoven scouring fabric and putting in a decreasing quantity while progressing toward the inside of the nonwoven scouring fabric. The last is especially favorable when the nonwoven scouring fabric is connected to a sponge. Then, for example, the outer surface of the nonwoven scouring fabric connected to the sponge can have a lesser quantity of reflectors, so that the user can recognize by the number of shiny points in the nonwoven scouring fabric that the nonwoven scouring fabric is more and more used up.

The thickness of the nonwoven scouring fabric as well as the quantity of reflectors incorporated in it may be different, depending on the application purpose of the nonwoven scouring fabric.

What is claimed is:

1. A nonwoven scouring fabric, comprising: a fabric made of interconnected coarse fibers forming a three-dimensional network, a continuous or a discontinuous layer of synthetic resin adhering to each of the fibers and having a content of abrasive grains, wherein reflectors are additionally bonded at the surface of the layer which are incorporated into the network via at least one of the sides of the nonwoven scouring fabric by a scattering procedure wherein, starting from an outer surface of the three-dimensional network and proceeding towards an inside, a decreasing quantity of reflectors is incorporated over the entire three-dimensional network the reflectors having mirroring surfaces.

2. The nonwoven scouring fabric according to claim 1, wherein the reflectors are made of mica.

3. The nonwoven scouring fabric according to claim 1, wherein the reflectors are made of light-reflecting plastic.

4. The nonwoven scouring fabric according to claim 1, wherein the reflectors have irregular shapes.

5. The nonwoven scouring fabric according to claim 2, wherein the reflectors have irregular shapes.

6. The nonwoven scouring fabric according to claim 3, wherein the reflectors have irregular shapes.

7. The nonwoven scouring fabric according to claim 1, wherein the reflectors are platelet-shaped.

8. The nonwoven scouring fabric according to claim 2, wherein the reflectors are platelet-shaped.

9. The nonwoven scouring fabric according to claim 3, wherein the reflectors are platelet-shaped.

10. The nonwoven scouring fabric according to claim 4, wherein the reflectors are platelet-shaped.

11. The nonwoven scouring fabric according to claim 1, wherein the reflectors are grain-shaped.

12. The nonwoven scouring fabric according to claim 2, wherein the reflectors are grain-shaped.

13. The nonwoven scouring fabric according to claim 3, wherein the reflectors are grain-shaped.

14. The nonwoven scouring fabric according to claim 4, wherein the reflectors are grain-shaped.

15. The nonwoven scouring fabric according to claim 2, wherein the reflectors are incorporated in the nonwoven scouring fabric uniformly over an entire cross section of the nonwoven.

16. The nonwoven scouring fabric according to claim 1, wherein, the nonwoven scouring fabric is connected to a sponge.

17. A nonwoven scouring fabric, comprising:

a fabric made of interconnected coarse fibers forming a three-dimensional network; and one of a continuous and a discontinuous layer of synthetic resin adhering to one surface of the three-dimensional network, wherein the resin has a content of abrasive grains, wherein reflectors are additionally bonded on the one surface of the three-dimensional network by a scattering procedure, wherein the reflectors are incorporated into the fabric starting from an outer surface of the three-dimensional network and proceeding towards an inside, a decreasing quantity of reflectors is incorporated over the entire three-dimensional network the reflector having mirroring sufaces.

18. The nonwoven scouring fabric according to claim 1, wherein an average size of the reflectors, is larger than the abrasive grains.

19. The nonwoven scouring fabric according the claim 17, wherein an average size of the reflectors, is larger than the abrasive grains.

20. The nonwoven scouring fabric according the claim 16, wherein an average size of the reflectors, is larger than the abrasive grains.

* * * * *